US007410547B2

(12) United States Patent
Lindqvist et al.

(10) Patent No.: US 7,410,547 B2
(45) Date of Patent: Aug. 12, 2008

(54) METHOD AND DEVICE FOR INHIBITING CONTAMINATION OF A WORKPIECE

(75) Inventors: Joachim Lindqvist, Gothenburg (SE); Dennis Lundström, Gothenburg (SE)

(73) Assignee: Volvo Aero Corporation, Trollhattan (SE)

( * ) Notice: Subject to any disclaimer, the term of this patent is extended or adjusted under 35 U.S.C. 154(b) by 740 days.

(21) Appl. No.: 10/709,231

(22) Filed: Apr. 22, 2004

(65) Prior Publication Data

US 2005/0023738 A1 Feb. 3, 2005

Related U.S. Application Data

(60) Provisional application No. 60/464,653, filed on Apr. 23, 2003.

(51) Int. Cl.
*C21D 1/773* (2006.01)

(52) U.S. Cl. ..... 148/628; 266/250

(58) Field of Classification Search ..... 148/628; 266/250

See application file for complete search history.

(56) References Cited

U.S. PATENT DOCUMENTS 3,853,637 A * 12/1974 Gray et al. ..... 148/628

* cited by examiner

*Primary Examiner*—Scott Kastler
(74) *Attorney, Agent, or Firm*—Novak Druce + Quigg LLP

(57) ABSTRACT

A method and device for inhibiting contamination of a workpiece during the heating of a workpiece by a contaminant. The method includes placing the workpiece in a first container, and, in a first step, filling the first container with a protective gas. The first container is placed in a second container, and in a second step, the second container, and hence the first container contained therein, is evacuated to create a vacuum inside the first and second containers so that during the first and second steps the partial pressure is reduced for the contaminants in the first container before the workpiece is heated.

16 Claims, 6 Drawing Sheets

METHOD AND DEVICE FOR INHIBITING CONTAMINATION OF A WORKPIECE

CROSS-REFERENCE TO RELATED APPLICATIONS

The present application claims the benefit of U.S. Provisional Application No. 60/464,653 filed 23 Apr. 2003.

TECHNICAL FIELD

The present invention relates to a method and a device for inhibiting contamination of a workpiece; that is, an object or article upon which the inventive teachings of the present invention are being executed.

Such a method and such a device can be used to inhibit contamination in various types of heat treatment of different products and components; for purpose of exemplification, but in no manner limitation, a description follows of how the method and the invention can be applied so as to inhibit one or more components from being contaminated when joined together by soldering in an oven.

BACKGROUND ART

There is a need within the aviation industry, for example, to heat-treat various types of workpieces. When various components, such as, for example, plates, are joined together by soldering, the components are heated in an evacuated oven. The oven is evacuated in order to create a vacuum in the oven and thereby lower the partial pressure for the unwanted chemical compounds which would otherwise react with the workpiece and cause contamination of the workpiece. Despite the fact that many vacuum ovens can have low pressures, they often have leaks in the construction which cause or permit air to filter or seep into the oven. For many types of materials, the pressure in such ovens is nevertheless sufficiently low for the oven to be able to be used to perform the heat treatment with the desired result. This means, however, that oven leaks often remain undetected and unsealed, since it is not profitable to try and obtain a better vacuum.

Workpieces made of highly contamination-sensitive materials, such as various titanium alloys, cannot, however, be heat-treated in such "leaky," and hence contaminated ovens. The properties of these materials are impaired even at relatively low partial pressures of certain contaminants, such as, for example, oxygen. Apart from the measures to increase pump capacity for evacuation of the oven or to make the oven as leak-tight as possible, an inert gas can be used to avoid contamination of the workpiece.

A related method is disclosed in DT 24 48 714 A1 which utilizes a protective gas. In this method, the partial pressures of unwanted gases are controlled by a flow of protective gas, such as argon, streaming continuously through the oven. The method does, however, have drawbacks. One drawback is that the purity of the oven atmosphere is determined by the purity of the protective gas. There are always contamination products present in a protective gas and these will be fed continuously to the oven together with the other gas. The oven is also required to be suitable for use of a protective gas, which means, in turn, that an existing oven may need to be modified; i.e., it is not possible to use just any vacuum oven, but rather the oven is required, for example, to have necessary gas connections. Moreover, a continuous flushing of the oven using a highly pure gas entails high gas consumption and for that reason involves substantial costs.

DISCLOSURE OF INVENTION

One object of the present invention is to provide a method of the type defined in the introduction, and which remedies or reduces at least some of the above-mentioned drawbacks of previously known methods; that is, to provide a method by which contamination (particularly detrimental contaminants-of-interest will typically be known) of a workpiece can be inhibited even when the workpiece is heated in a relatively impure oven.

The inventive method includes a first step a first container is flushed and filled with a protective gas. In a second step, a second container, preferably an oven, and then the first container are evacuated to create a vacuum inside the first and second containers so that during the first and second steps, the partial pressure for the contaminant in the first container is reduced before the workpiece is heated, and this means that the likelihood of substantial contamination of the workpiece is diminished. The initial concentration of a contaminant in the first container can be considerably reduced by such a method. This method should not be confused with previously known methods in which continuous flushing of the oven is required throughout the heating process in order to inhibit contamination of the oven and of the workpiece being heated. According to methods conducted according to the teachings of the present invention, the first container can be flushed and filled with a protective gas, for example argon, as a one-off measure, and placed in the second container, where after necessary evacuation is performed.

In the subsequent heating of the workpiece, either a duct, preferably a duct of relatively large volume which can act as a buffer in case of pressure fluctuations in the second container, and/or a valve system can be used to establish an atmospheric connection between the first and second container while contamination of the workpiece is inhibited. The difference in partial pressure between the contaminant in the second container and the contaminant in the first container, which difference can arise during heating as a result of leaks from the environment into the second container, tends to be equalized by the transport of such contaminant from the second container in the direction of the first container. The use of a duct which has a cross section possessing at least one dimension with an extent in the same order of magnitude as the mean free path, and preferably less than the mean free path, which the contaminant has in the atmosphere prevailing in the duct as the workpiece is heated increases the likelihood of such a contaminant reacting with the limit face of the duct, whereby the transport of such a contaminant to the first container is inhibited.

What is meant here, of course, is that such a duct should have one cross-sectional extent that is substantially larger than the cracks/leaks which might be present in the first container and which might be identified visually or with a microscope. It is generally the case that the better the vacuum which can be obtained, the larger is the permitted cross-sectional dimension of the duct. In many applications, the mean free path for the molecules of the contaminant is on the order of magnitude of a few millimeters.

By means of a duct, the extent of which in the longitudinal direction is many times larger than the extent of the at least one cross-sectional dimension of the duct, the likelihood of a contaminant being able to reach the first container can be further diminished by exposing the contaminant in the duct to a relatively large surface area in relation to the path over which the contaminant has to be transported in order to make its way inside the first container and the workpiece. The likelihood of the contaminant reacting with the limit face of the duct is thereby, in turn, substantially increased.

The use of a valve system instead of, or in combination with a duct requires a slightly more advanced first container, but has the advantage that transport of the contaminant (contamination) from the second container to the first container during the heating phase can be very effectively inhibited. In the evacuation of the first and the second containers, a valve in the first container is opened to establish an atmospheric connection between the first container and the second container, and the valve is closed following completed evacuation. In the heating of the workpiece, a valve in the first container is opened at a total pressure in the second container exceeding a predetermined value or at a pressure difference between the first and second container exceeding a predetermined value. In order to inhibit contamination from being transported to the first container, the pressure at which the valve will open should be higher than pressure fluctuations arising in the second container, but lower than the pressure required to compress the first container at the temperature in question in order to avoid damage to the first container.

A further object of the present invention is to provide a device of the type defined in the introduction which is suitable for use in implementation of the method taught according to the presently described invention. A major advantage of this embodiment of the invention is that the device can be used for various types of pre-existing vacuum ovens. The device is portable and, if so desired, can be reused and moved between different ovens without the ovens having to be specially modified. A cost-effective method for heating workpieces while inhibiting contamination of the workpiece, and a method which is applicable in most vacuum ovens, are therefore obtained.

Other advantages of method conducted, and devices configured according to the teachings of the invention can be gleaned from the following detailed description, the accompanying illustrations and the claims.

BRIEF DESCRIPTION OF THE DRAWINGS

Preferred embodiments of the invention are described below, by way of example, and with reference to the appended drawings, in which.

MODE FOR THE INVENTION

Figure 1:
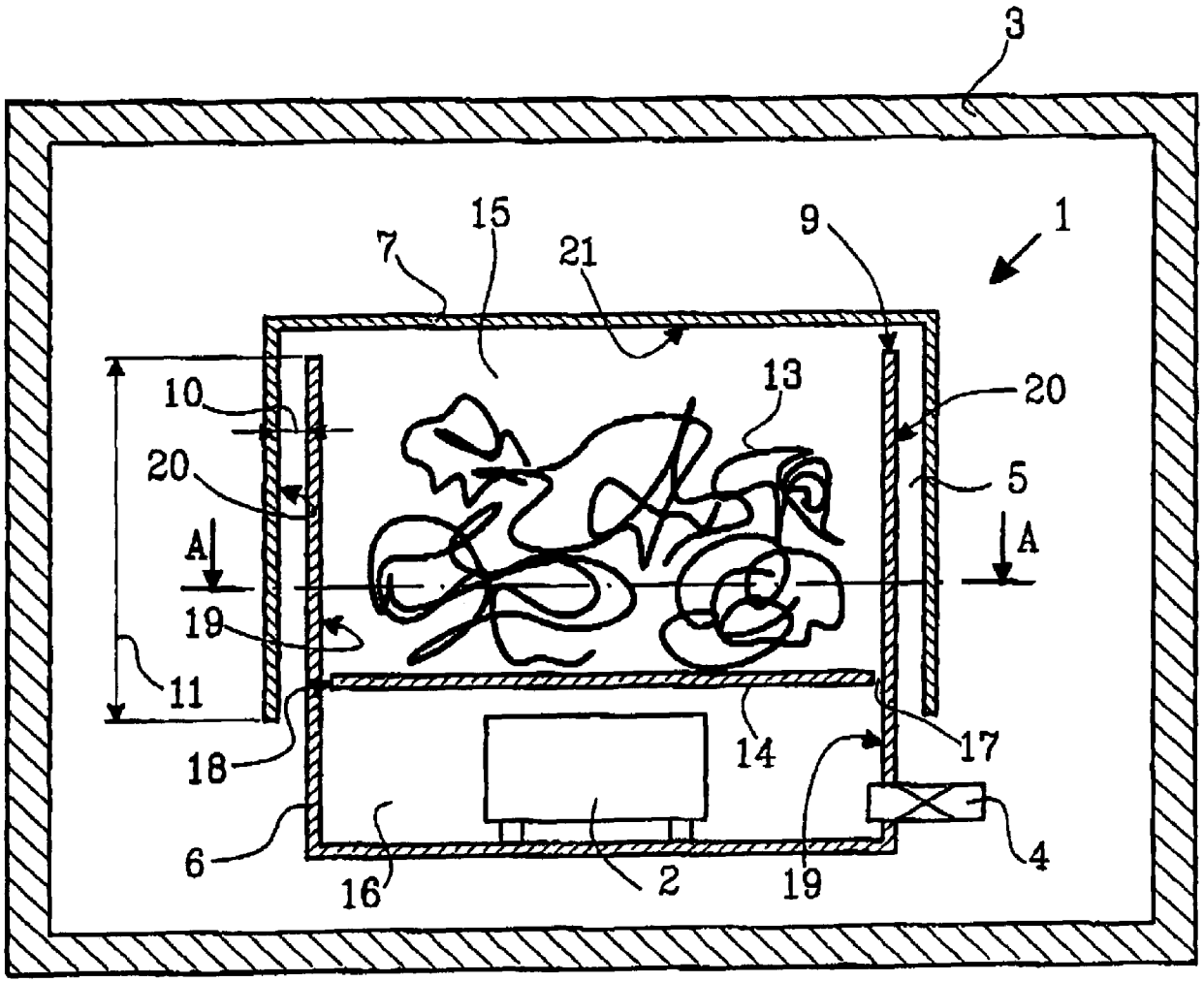
FIG. 1 is a diagrammatic view illustrating a device configured according to the present invention.
Figure 2:
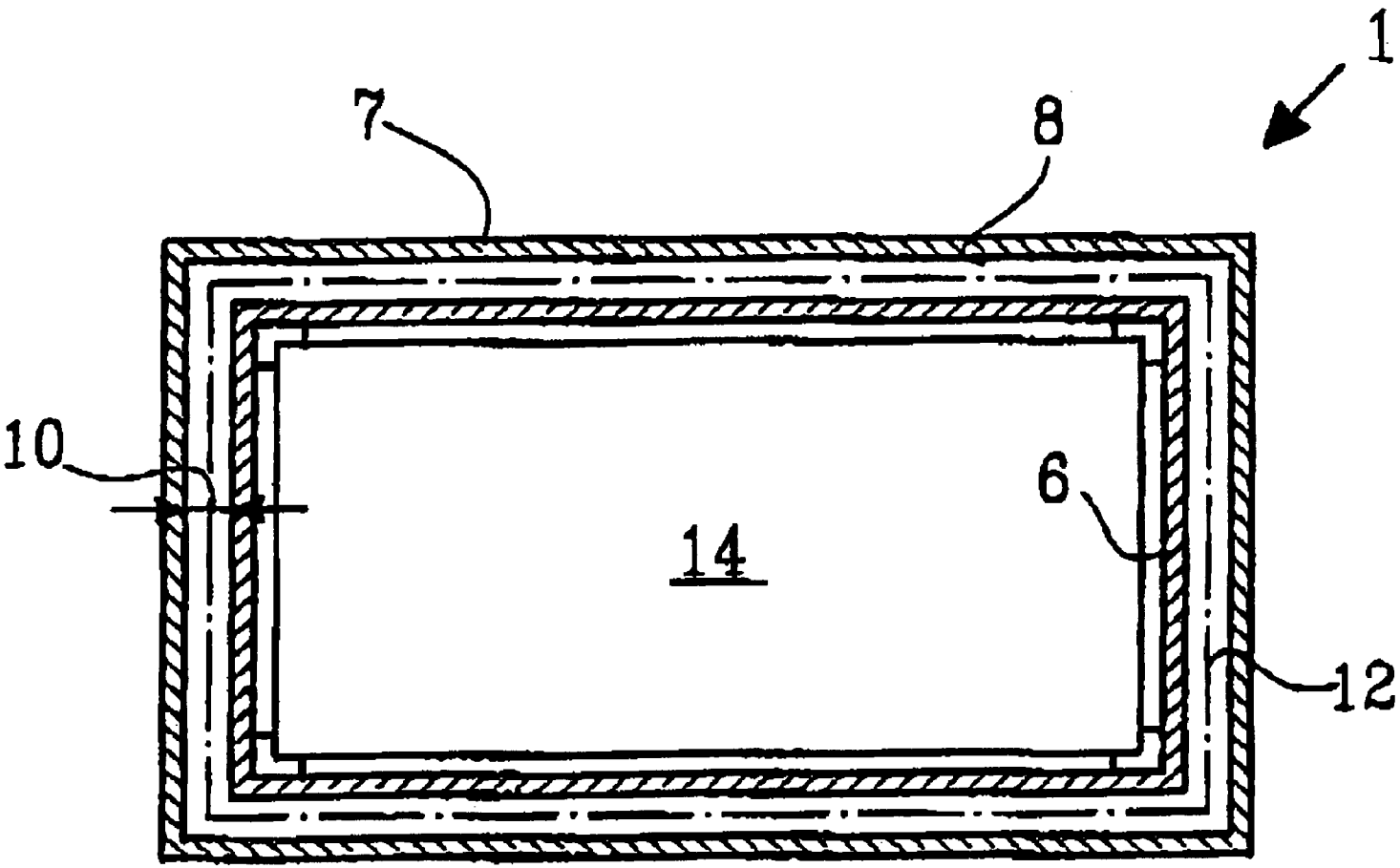
FIG. 2 is a cross-sectional view of the device illustrated in FIG. 1.

In FIGS. 1 and 2, an inventive device suitable for use in the implementation of the method according to the invention is diagrammatically illustrated. The device comprises (includes, but is not limited to) a first container 1 for accommodating a workpiece 2, which first container 1 is intended for placement in a second container 3 as the workpiece 2 is heated. The second container 3 can be any arbitrary oven which is provided with a pump so that a vacuum can be created in the oven during heat-treatment of workpieces 2 therein. The invention can be applied at different vacuum levels, and total pressure in the oven on the order of magnitude of $10^{-2}$ mbar has proved to be appropriate. The first container 1 further comprises a first means 4 for introduction of a protective gas and a second means 5 for establishment of an atmospheric connection between the first container 1 and the second container 3. In the example illustrated in FIG. 1, the first means is a valve 4, with associated connections, disposed in the first container 1 and the second means is a duct 5 connecting the first container 1 to the environment; i.e. to the second container 3 when the first container 1 is placed in the second container 3. The first container has at least one such duct, but, in another embodiment, could have two or more ducts of this nature.

Although the duct 5 can be produced in a variety of ways and be within the scope of the present invention, the device in the embodiment illustrated in FIG. 1, which has a first container 1 consisting of two parts 6, 7, in the form of a box 6 and a lid 7 for the box, for accommodating the workpiece 2 and, at the same time, creating the duct 5, has the advantage that no special means is required to open and close the first container 1 when a workpiece 2 is to be placed in or taken out. The lid 7 can quite simply be removed from the box 6, after which access is gained to the interior of the box.

The lid 7 is disposed in the first container 1 such that the duct 5 is formed between the lid 7 and the box 6. The cross section 8 of the duct 5 is therefore, in this case, annular. In order to produce the duct 5, one or more fixed or loose distancing elements (not shown) is disposed between the upper edge 9 of the box and the lid 7, and which are used to position the lid 7 and the box 6 in relation to each other so that a desired gap is obtained therebetween. The duct 5 expediently has a cross section 8 possessing at least one dimension 10, here the gap width 10 between the lid and the box in the horizontal direction, with an extent in the same order of magnitude as the mean free path which the contaminant has in the atmosphere prevailing in the duct 5 as the workpiece 2 is heated. The duct 5 preferably has a cross section possessing at least one dimension with an extent which is less than the mean free path which the contaminant has in the atmosphere prevailing in the duct 5 as the workpiece 2 is heated.

Advantageously, the duct 5 has an extent in the longitudinal direction 11 which is many times greater than the extent of at least one cross-sectional dimension 10 of the duct 5 and, preferably, the duct 5 has an extent in the longitudinal direction 11 which is more than 10 times greater than the extent of at least one cross-sectional dimension of the duct 5. In certain cases, an extent of the duct which is 50 times, and preferably 100 times greater than the extent of at least one cross-sectional dimension of the duct is more advantageous. It is desirable if the volume of the duct 5 is relatively large. This means that the duct 5 expediently has a second sizeable cross-sectional dimension and, as described earlier, a large extent in the longitudinal direction.

In the embodiment illustrated in FIGS. 1 and 2, a cross-sectional dimension 12 of the duct 5 extends along the whole of the circumference of the first container 1, which means that, despite the relatively small extent of the gap 10 between the box 6 and the lid 7, the duct 5 has a relatively large cross-sectional area 8. The volume of the duct 5 (the length of the duct times the cross-sectional area of the duct—and in this case, the duct length times the gap width times the box circumference) is expediently tailored to the volume of the first container so that the volume relationship $V_1/V_k$ between the volume $V_1$ of the first container and the volume $V_k$ of the duct is less than 20, preferably less than 15 and, more preferably, less than 10. There is also a possibility of further reducing the contamination of the workpiece 2 through the use of piece goods 13, in the form of chips, for example, for providing surfaces for the capture of the contaminants by a reaction between the contaminant and the surfaces of the piece goods 13. It should be emphasized that, although the term "chips" 13, i.e. material separated in the machine-working of a workpiece, is used frequently below, it is also possible to use other piece goods which are thread-like or particulate in form, such as, for example, a powder or the like, and which have surfaces suitable for capturing a contaminant.

A device configured according to the embodiment shown in FIGS. 1 and 2 comprises a means 14, for example a dividing plate, for dividing the first container 1 into a first chamber 15 and a second chamber 16. The dividing plate 14 is tailored to the shape and size of the first container 1 so that a gap 17 is formed between the outer edge 18 of the dividing plate 14 and the inner limit face 19 of the first container 1. Chips 13 with high affinity for one or more contaminants can hence be disposed in the first chamber 15, so that, while the first and the second chamber 15, 16 of the first container 1 are in mutual atmospheric connection, the chips 13 are separated from the workpiece 2 present in the second chamber 16.

Along its periphery, the dividing plate could have flanges, such as plates, which are essentially parallel with the inner limit face of the first container, so that the gap 17 acquires a larger extent in the longitudinal direction (in the vertical direction in FIG. 1), which means that a second duct is formed between the flanges and the internal limit face of the first container. The second duct, which therefore, in this case, connects the first and the second chamber, can be dimensioned so that it acquires essentially identical properties to the above mentioned duct situated between the box and the lid. The chips 13 can be made of titanium, for example, and can advantageously be made of the same material as the workpiece 2 to be heat-treated or soldered. A material with high affinity for the contaminant can also be utilized in the production and/or preparation of the first container 1. For example, the internal face 20 of the duct and/or the inner side 19 of the first container can be lined with such a material in order to further reduce the risk of contamination of the workpiece. Through a choice of dimensions of the device and/or materials of the device and/or the chips, the methods and the devices configured according to the invention can be tailored to the specific contaminant against which it is wished to protect the workpiece.

A number of variants of devices configured according to the present invention will be described below for purposes of exemplification. It should be pointed out, however, that those features will primarily be described which differ from the previously described embodiments of the device according to the invention, whereas a description of common, aforementioned features and properties is omitted. The second container, with which the first container is intended to interact, is also omitted in all cases. Furthermore, the same reference notations are used for identical or corresponding components of the different variants.

Figure 3:
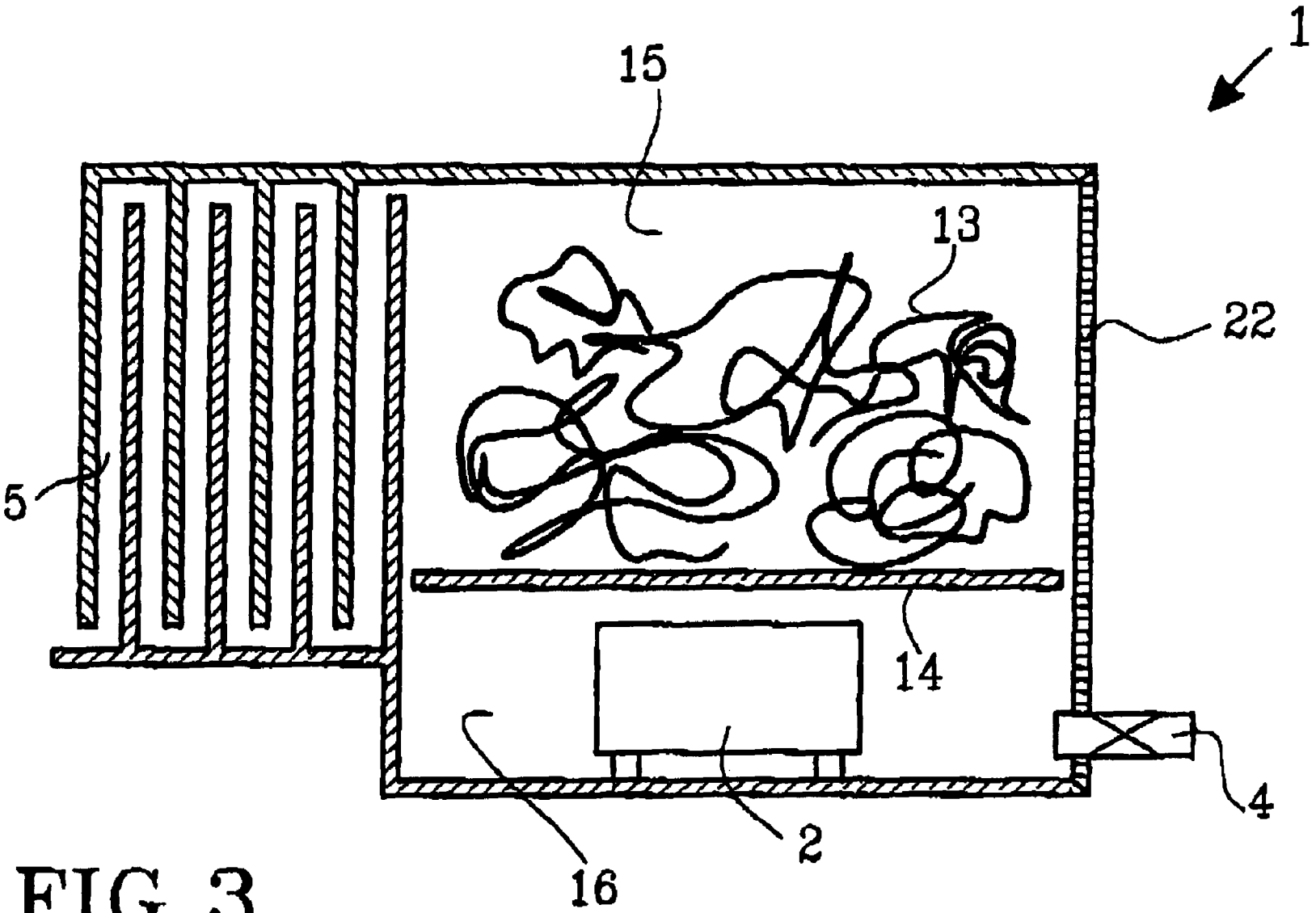
FIG. 3 is a diagrammatic view illustrating another embodiment or variant of a device configured according to the invention.

In FIG. 3, a variant of the inventive device is diagrammatically illustrated and in which the duct 5 is configured as an elongate, serpentine loop having a purpose to inhibit contaminants (contamination) from reaching the workpiece. In this way, a long duct 5 is obtained, but in a space-saving manner. In order to be able to introduce and withdraw the workpieces into/from the first container 1, the latter is provided with a tight-shutting door 22 or lid or the like, so that the container 1 can be opened and closed as required.

Figure 4:
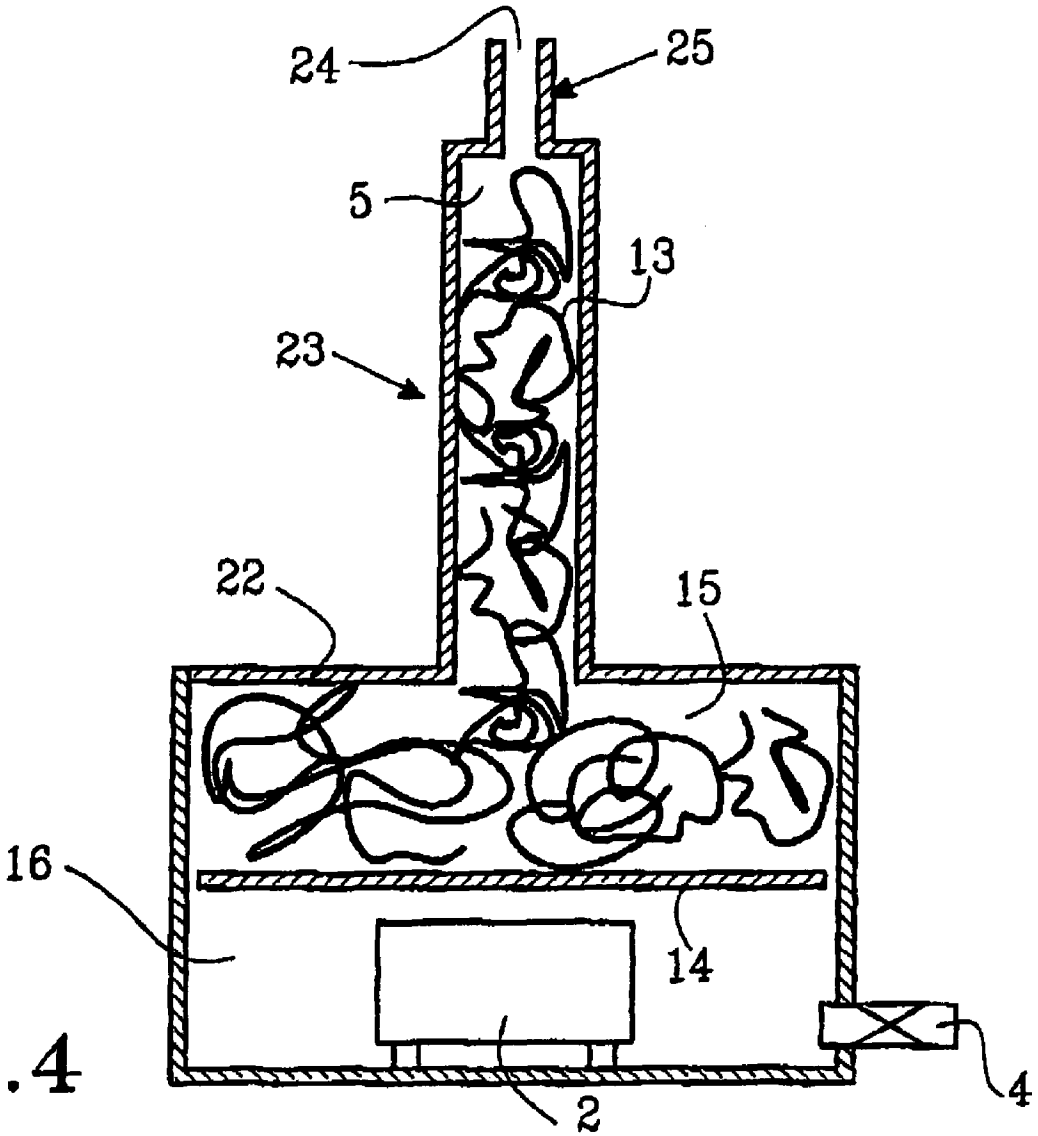
FIG. 4 is a diagrammatic view illustrating a further embodiment or variant of a device configured according to the invention.

In FIG. 4, a further variant of an illustrative device is diagrammatically shown in which the duct 5 is configured as an elongated column. The column has a first portion 23, of larger cross-sectional area, disposed next to the first container 1, and which portion contains chips 13 with high affinity for a contaminant, and a second portion 25, of smaller cross-sectional area, disposed next to the environment-facing mouth 24 of the duct 5. In this case, the outer portion 25 of the duct 5 can have a cross-sectional dimension on the order of magnitude described earlier in this application, whereas the inner portion 23, in certain cases, can be permitted to have larger cross-sectional dimensions which allow chips 13 to be placed in a practical manner in the column. The column and a lid 22 which shuts tight against the container can be made integrated in a detachable part to enable the first container 1 to be opened and closed.

Figure 5:
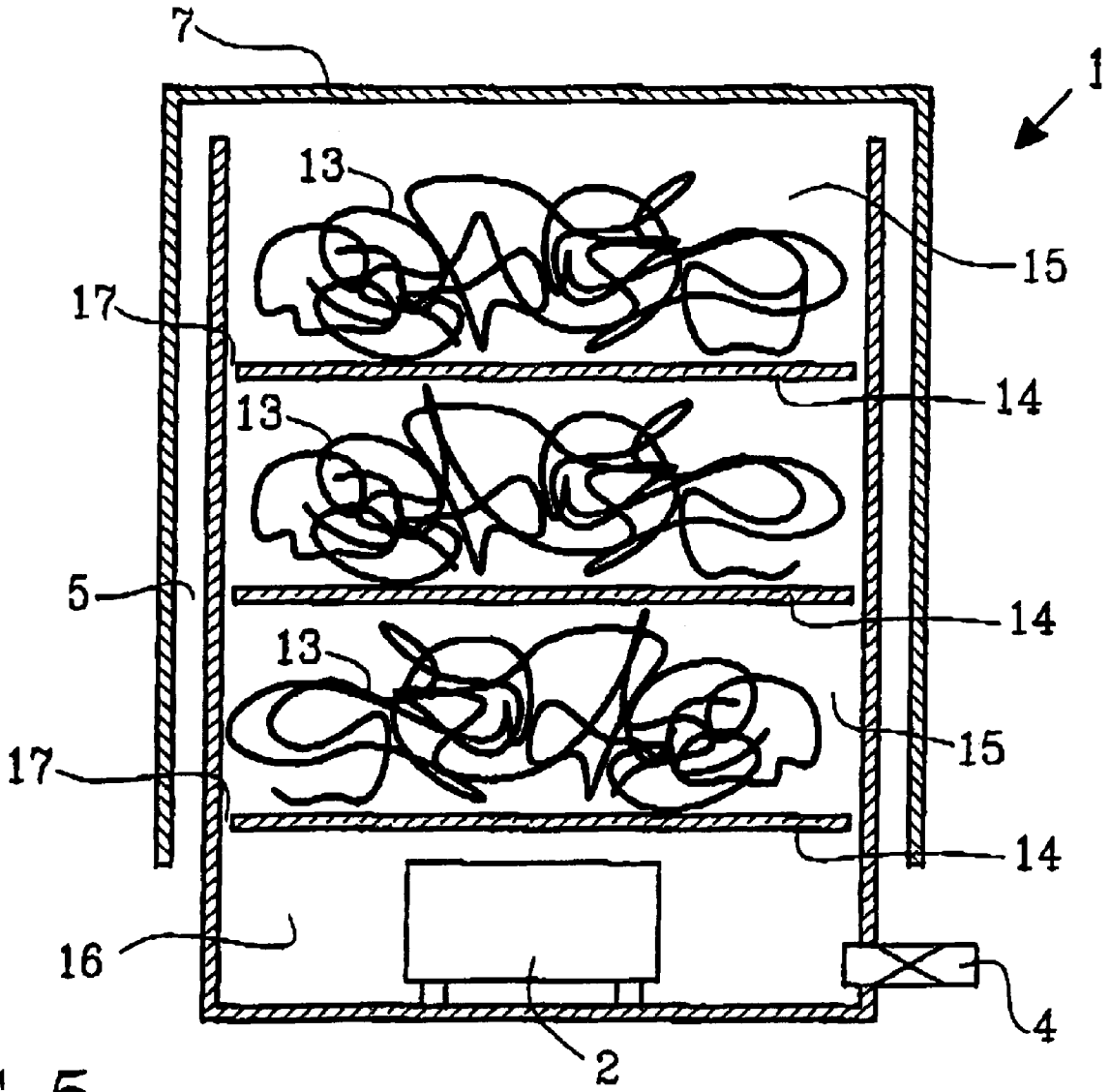
FIG. 5 is a diagrammatic view illustrating still a further embodiment or variant of a device configured according to the invention.

In FIG. 5, a further variant of the device according to the invention is illustrated diagrammatically, in which the first container 1 is provided with a plurality of chambers 15 for the accommodation of chips 13 at different levels in the first container 1. A dividing plate 14 is disposed between each set of two mutually adjoining chambers so that a gap 17 is formed between the outer edge of the dividing plate and the internal limit face of the first container. As regards different embodiments of the dividing plates, reference is made to the description provided in connection with FIGS. 1 and 2.

Figure 6:
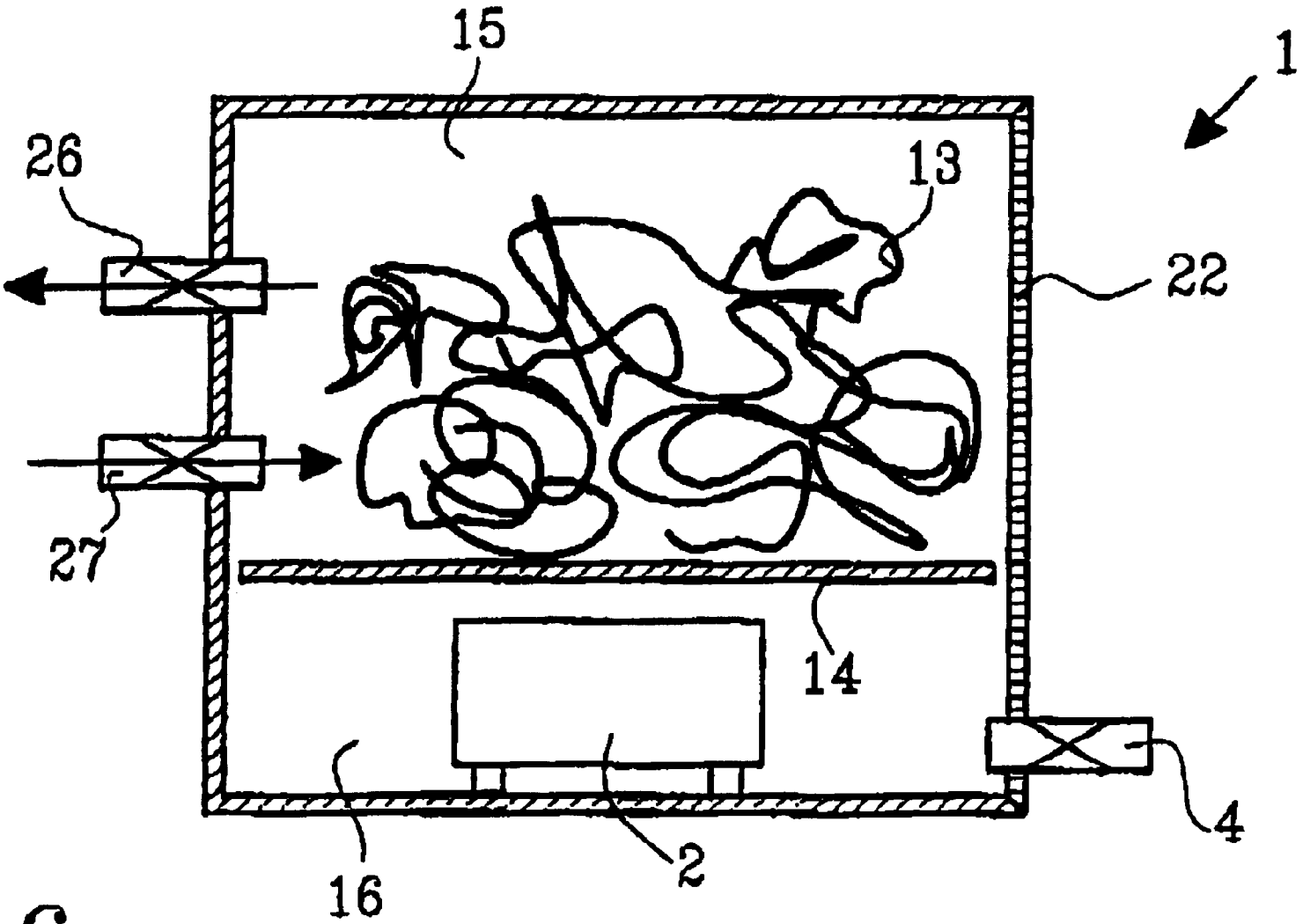
FIG. 6 is a diagrammatic view illustrating a yet a further embodiment or variant of a device configured according to the invention, utilizing valves instead of a duct.

In FIG. 6, a further variant of the device according to the invention is illustrated diagrammatically, utilizing valves instead of a duct to establish the necessary connection with the environment; i.e., with the second container when the first container 1 is placed in the second container. Although the first container is provided with three valves 4, 26, 27 in the example illustrated in FIG. 6, it is possible, at least in certain cases, to utilize a lesser number of valves by making it/them multifunctional. In the example in question, the first valve 4 constitutes a means for introducing protective gas into the first container. By means of a second valve 26, a connection between the first container 1 and the second container can be provided when the containers are evacuated before the workpiece is heated. A third valve 27 is designed, during heating of the workpiece, to equalize any pressure differences between the first 1 and second container 3 should a difference in total pressure arise between the first and second container, which difference risks damaging the first container 1.

Experiments have been conducted with various embodiments of the device according to the invention. For example, successful trials have been conducted with the following dimensions of the device:

Trial 1: The volume of the first container, $V_1$=1.75 $dm^3$, the length of the duct, 1.=100 mm, and the cross-sectional dimensions of the duct, B×t=500×5 mm, which gives a relationship between the duct length and gap width, L/t=20, and a volume relationship between the first container and the duct volume, $V_1V_k$=14.

Trial 2: The volume of the first container, $V_1$=15 $dm^3$, the length of the duct, L=250 mm, and the cross-sectional dimensions of the duct, B×t=1 000×5 mm, which gives a relationship between the duct length and gap width, L/t=50, and a volume relationship between the first container and the duct volume, $V_1V_k$=12.

In the implementation of the method according to the invention, a workpiece which is required to be heated, for example for the execution of a soldering, is placed in a first container. In a first step, the first container is flushed and filled with a protective gas. The duration of the flushing is tailored to the geometric complexity of the workpiece and can range from a few minutes to a number of hours. Flushing of the container with a protective gas, such as, for example, argon, results in partial pressure for the contaminant being lowered. The first container filled with protective gas is then placed in a second container, preferably an oven and, in a second step, the partial pressure of the contaminant in the first container is further lowered by the evacuation of the second container, and hence the first container, to create a vacuum inside the first and second container. The air is thus pumped out of the oven and the protective gas and remaining contaminants flow out of the first container to the second container and onward out from the second container to the environment.

In this way, the total pressure, on the one hand, and the oxygen partial pressure, for example, on the other hand, is lowered. Oxygen is an agent which, when workpieces made of certain materials are heated, should as far as possible be minimized in the atmosphere surrounding the workpiece, since the oxygen can otherwise react with the material and form compounds and/or phases which produce undesirable properties of the material. Other examples of contaminants are various nitrogen compounds and gaseous carbon compounds. Following creation of a vacuum in the first container, the first container and the workpiece placed therein can be heated in the oven in order to perform a desired heat treatment and/or joining together of different components of the workpiece.

In the trials, a volume $V_2$=0.5–1 $m^3$ for the second container has been used. The invention is not, of course, limited to the volume of the second container, but a relatively small oven is advantageous. A larger-volume oven, which tends to equalize the oxygen partial pressure inside the first container, will contaminate the first container to a greater extent than a smaller-volume oven.

Although, as stated above, it may be advantageous first to flush and fill the first container with protective gas and then place it in the second container; it should, however, be stressed that the first container could very well be placed in the second container first and then flushed and filled with protective gas.

The invention is not, of course, limited to the embodiments of the invention described herein, but is only limited by the following patent claims. Once the concept of the invention is known, a number of modifications within the scope of the invention will no doubt be apparent to a person skilled in the art. For example, in one embodiment of the invention, a valve system could be used in combination with a duct and these components could interact so that, when the valve is opened at a certain total pressure in the second container, contamination of the workpiece can still be inhibited by the fact that the contaminant, after having passed through the valve, must pass through the duct in order to get into the first container.

The invention claimed is:

1. A method for, in the heating of a workpiece, inhibiting contamination of the workpiece by a contaminant, said method comprising:

placing the workpiece in a first container;

flushing said first container and then filling said first container with a protective gas;

placing said first container in a second container and evacuating said second container, and consequently said first container placed therein, thereby creating a vacuum inside said first and second containers and reducing the partial pressure for a contaminant-of-interest present in said first container before the workpiece is heat treated; and opening a valve between said first and second containers during evacuation thereof and thereby establishing an atmospheric connection therebetween, and subsequently closing said valve when evacuation is completed.

2. A method for, in the heating of a workpiece, inhibiting contamination of the workpiece by a contaminant, said method comprising:

placing the workpiece in a first container;

flushing said first container and then filling said first container with a protective gas;

placing said first container in a second container and evacuating said second container, and consequently said first container placed therein, thereby creating a vacuum inside said first and second containers and reducing the partial pressure for a contaminant-of-interest present in said first container before the workpiece is heat treated; and heat treating the workpiece, and during said heat treatment, opening a valve between the first and second containers when at least one of (1) the pressure in said second container exceeds a predetermined value and (2) a pressure difference between said first and second containers exceeds a predetermined value, thereby inhibit compression of said first container.

3. A method for, in the heating of a workpiece, inhibiting contamination of the workpiece by a contaminant, said method comprising:

placing the workpiece in a first container;

flushing said first container and then filling said first container with a protective gas;

placing said first container in a second container and evacuating said second container, and consequently said first container placed therein, thereby creating a vacuum inside said first and second containers and reducing the partial pressure for a contaminant-of-interest present in said first container before the workpiece is heat treated;

placing piece goods in said first container thereby providing surfaces that capture contaminant-of-interest by way of a reaction therewith; and locating said piece goods in a first chamber of the first container separate from the workpiece positioned in a second chamber of the first container, said first chamber being in open fluid communication with said second chamber.

4. A method for, in the heating of a workpiece, inhibiting contamination of the workpiece by a contaminant, said method comprising:

placing the workpiece in a first container;

flushing said first container and then filling said first container with a protective gas;

placing said first container in a second container and evacuating said second container, and consequently said first container placed therein, thereby creating a vacuum inside said first and second containers and reducing the partial pressure for a contaminant-of-interest present in said first container before the workpiece is heat treated; and placing piece goods in said first container thereby providing surfaces that capture contaminant-of-interest by way of a reaction therewith;

wherein said piece goods are located in said duct thereby creating surfaces for the capture of the contaminant-of-interest by surface reaction therewith.

5. The method as recited in claim 3, further comprising:

heat treating the workpiece, and during said heat treatment, inhibiting transport of the contaminant-of-interest from said second container to said first container by causing the contaminant-of-interest to pass through a duct between the first and second containers.

6. The method as recited in claim 5, wherein said duct has a cross section possessing at least one dimension having an extent in the same order of magnitude as the mean free path which the contaminant-of-interest has in the atmosphere prevailing in the duct during the heat treatment.

7. The method as recited in claim 5, wherein said duct has a cross section possessing at least one dimension having an extent less than the mean free path which the contaminant-of-interest has in the atmosphere prevailing in the duct during the heat treatment.

8. The method as recited in claim 5, wherein said duct has a cross section possessing a longitudinal dimension having an extent that is multiply times greater than an extent of at least one cross-sectional dimension of the duct.

9. The method as recited in claim 8, wherein said duct has a cross section possessing a longitudinal dimension having an extent that is at least ten times greater than an extent of at least one cross-sectional dimension of the duct.

10. The method as recited in claim 8, wherein said duct has a cross section possessing a longitudinal dimension having an extent that is at least fifty times greater than an extent of at least one cross-sectional dimension of the duct.

11. The method as recited in claim 8, wherein said duct has a cross section possessing a longitudinal dimension having an extent that is at least one hundred times greater than an extent of at least one cross-sectional dimension of the duct.

12. The method as recited in claim 5, wherein said first container has a volume that is less than twenty times greater than a volume of said duct.

13. The method as recited in claim 5, wherein said first container has a volume that is less than fifteen times greater than a volume of said duct.

14. The method as recited in claim 5, wherein said first container has a volume that is less than ten times greater than a volume of said duct.

15. The method as recited in claim 3, wherein the first container is filled with the protective gas before being placed in said second container.

16. The method as recited in claim 3, wherein the workpiece is heated for subsequent soldering.

* * * * *